US007103933B2

(12) United States Patent
Gladney et al.

(10) Patent No.: US 7,103,933 B2
(45) **Date of Patent: *Sep. 12, 2006**

(54) MATTRESS AND BED ASSEMBLY PROVIDING AN ENLARGED SLEEPING SURFACE AREA

(75) Inventors: Rick F. Gladney, Fairburn, GA (US); Kurtis A. Ling, Alpharetta, GA (US)

(73) Assignee: Dreamwell Ltd., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/760,333

(22) Filed: Jan. 20, 2004

(65) Prior Publication Data

US 2005/0034240 A1 Feb. 17, 2005

Related U.S. Application Data

(63) Continuation of application No. 10/193,770, filed on Jul. 10, 2002, now Pat. No. 6,678,905, which is a continuation of application No. 09/760,195, filed on Jan. 12, 2001, now Pat. No. 6,519,798, and a continuation-in-part of application No. 09/680,259, filed on Oct. 5, 2000, now Pat. No. 6,557,198.

(51) Int. Cl.
*A47C 23/00* (2006.01)

(52) U.S. Cl. ..... 5/690; 5/400; 5/701; 5/717; 5/411; 5/659

(58) Field of Classification Search ..... 5/186.1, 5/200.1, 400–402, 411, 193, 690, 691, 717, 5/739, 8, 728, 659, 661, 903
See application file for complete search history.

(56) References Cited

U.S. PATENT DOCUMENTS 871,871 A * 11/1907 Hirschman ..... 5/401
1,144,123 A 6/1915 Haas
1,907,659 A 5/1933 Pearce, Jr.

(Continued)

FOREIGN PATENT DOCUMENTS

DE 8809029 3/1989

(Continued)

OTHER PUBLICATIONS

Webpage available at http://www.kentwebnet.com/specialist-beds/index.htm.

(Continued)

*Primary Examiner*—Michael Trettel
(74) *Attorney, Agent, or Firm*—Fish & Neave IP Group, Ropes & Gray LLP

(57) ABSTRACT

A bed assembly provides an enlarged sleeping surface area as compared to a standard Queen sized bed. Specifically, in the disclosed bed assemblies, the sleeping surface area is about 64 inches to about 68 inches wide and about 77 inches to about 82 inches long. This can be accomplished by providing both a mattress and a foundation having the appropriate, enlarged sleeping surface area, or by combining an enlarged mattress with a foundation having at least one standard Queen sized surface. The mattress and foundation can be fit into a bed frame made of a suitable size to fit the bottom surface of the foundation (i.e., either "enlarged" or standard Queen size). The enlarged sleeping surface of the bed may be between about 65 inches to about 67 inches wide and about 78 inches to about 80 inches long. This enlarged sleeping surface area provides a more comfortable and restful sleep for two occupants.

11 Claims, 6 Drawing Sheets

U.S. PATENT DOCUMENTS

| | | | | | |
|---|---|---|---|---|---|
| 2,021,430 | A | | 11/1935 | Platt | |
| 2,661,486 | A | | 12/1953 | Roher | |
| 2,826,765 | A | | 3/1958 | Entwistle | |
| 2,847,685 | A | * | 8/1958 | Abraham | 5/659 |
| 3,022,523 | A | | 2/1962 | Schmutz | |
| 3,125,768 | A | | 3/1964 | Ricket | |
| 3,512,191 | A | | 5/1970 | Wall et al. | |
| 3,737,925 | A | | 6/1973 | Oxford | |
| 3,745,289 | A | | 7/1973 | Hipple | |
| 3,837,020 | A | * | 9/1974 | Bosch | 5/411 |
| 4,155,131 | A | | 5/1979 | Harris et al. | |
| 4,169,294 | A | | 10/1979 | Harris | |
| 4,532,662 | A | | 8/1985 | Sama | |
| 4,639,952 | A | | 2/1987 | Kensinger | |
| 4,651,370 | A | | 3/1987 | Vitale | |
| 5,289,600 | A | | 3/1994 | Schermel | |
| 5,379,470 | A | * | 1/1995 | Morgan | 5/692 |
| 5,819,349 | A | | 10/1998 | Schwartz | |
| 6,243,900 | B1 | | 6/2001 | Gladney et al. | |
| 6,510,571 | B1 | | 1/2003 | Tittle et al. | |
| 6,519,798 | B1 | * | 2/2003 | Gladney et al. | 5/690 |

FOREIGN PATENT DOCUMENTS

| | | |
|---|---|---|
| GB | 458036 | 12/1936 |

OTHER PUBLICATIONS

Webpage available at http://www.royal-pedic.com/html/custom.cfm.

Wetpage available at http://www.yourdesignmattress.com/aboutus.html.

* cited by examiner

MATTRESS AND BED ASSEMBLY PROVIDING AN ENLARGED SLEEPING SURFACE AREA

RELATED APPLICATIONS

The present application is a continuation of U.S. Ser. No. 10/193,770, filed Jul. 10, 2002, now U.S. Pat. No. 6,678,905, which is a continuation of U.S. Ser. No. 09/760,195, filed on Jan. 12, 2001, now U.S. Pat. No. 6,519,798, and a continuation-in-part of U.S. Ser. No. 09/680,259, filed Oct. 5, 2000, now U.S. Pat. No. 6,557,198, the specifications of which are incorporated by reference herein.

BACKGROUND OF THE INVENTION

This invention relates to mattresses and foundations for beds, and particularly to mattresses and/or foundations that provide an enlarged sleeping surface area as compared to a conventional Queen sized bed.

In 1958, the predecessor of Simmons Company, the assignee of the present invention, introduced the Queen sized mattress. The dimensions of the Queen sized mattress were derived through research by Simmons in which average sized couples were asked to sleep on mattresses of unrestricted size. During the course of the night's sleep, the couples were observed, and the area which the couples occupied during the night was measured. Based on area occupied, the dimensions for the Queen sized mattress was established. Later in the 1960s, King sized mattresses were introduced to cater to people who were larger than average size, and who needed a larger sleeping area.

Since 1958, the average size of a woman in United States has increased by 13 pounds, and the average size of a man has increased by 19 pounds. The increase in size of average Americans suggests the need for a larger sleeping surface area for such couples occupying a single bed.

Standard bed sizes (American National Standard 2357.1-1981) published by the International Sleep Association are as follows:

| | |
|---|---|
| Twin: | 38 inches by 74.5 inches; |
| Twin Extra-Long: | 38 inches by 79.5 inches; |
| Double: | 53 inches by 74.5 inches; |
| Double Extra-Long: | 53 inches by 79.5 inches; |
| Queen: | 60 inches by 79.5 inches; |
| King: | 76 inches by 79.5 inches; |
| California King: | 72 inches by 83.5 inches. |

Typically, the twin bed size is suitable for individual children, and the double bed size is suitable for individual adults. A Queen sized bed cannot always comfortably accommodate two people as suggested by the increase in average size of Americans since 1958. Particularly, if at least one of the people is of relatively large stature or if at least one of the people is a relatively light sleeper or a restless sleeper, a Queen sized mattress is likely to be considered too small for an average couple. Because of the close proximity of occupants in a Queen sized bed, movement by one occupant of the bed is transferred to and tends to wake up or keep up the other bed occupant. While appropriate selection of the inner core spring construction and padding may help reduce this transfer of motion, beds of such construction tend to be less comfortable to users.

Generally, because of their larger sizes, two people can be comfortably accommodated in King sized or California King sized beds. These beds, however, are so large that they do not always easily fit inside a bedroom and/or they do not leave sufficient space in a room to accommodate other furniture that is typically desired in a bedroom. Moreover, the increased costs of King sized and California King sized mattresses, foundations, bed frames, and bedding make these very large bed sizes disadvantageous.

Thus, there is a need for a mattress, foundation, and/or bed assembly that provides a reduced transfer of motion between bed occupants and an enlarged sleeping surface area as compared to conventional Queen sized beds but that is not so large as to overfill or cramp the available space in conventional sized bedrooms.

SUMMARY OF THE INVENTION

This invention relates to a bed assembly that provides an enlarged sleeping surface area as compared to a standard Queen sized bed. Particularly, the bed assembly according to the invention has a sleeping surface area of about 64 inches to about 68 inches wide and about 77 inches to about 82 inches long. This enlarged width is between the standard sizes for Queen sized and King sized beds.

One embodiment of the invention has a mattress, comprising: a top surface; a bottom surface; and an inner core between the top surface and the bottom surface. The mattress is about 64 inches to about 68 inches wide and about 77 inches to about 82 inches long. In this specification, a mattress having the dimensions described above also will be called an "enlarged" mattress.

In another aspect of the invention, the above-described enlarged mattress can be used with a foundation for supporting the mattress. In this aspect of the invention, the foundation (e.g., a box spring) comprises: a top support surface; a bottom support surface; and an inner support structure between the top support surface and the bottom support surface, wherein the foundation is about 64 inches to about 68 inches wide and about 77 inches to about 82 inches long. A foundation having these dimensions also will be referred to in this specification as having an "enlarged" size. The enlarged mattress and enlarged foundation can be used together, optionally with an independent base frame unit of appropriate size, to provide a bed assembly.

In another embodiment of the invention, a mattress, having an enlarged sleeping surface area as compared to a standard Queen sized mattress, is used in combination with a standard Queen sized foundation. This can be accomplished in several different ways. For example, in one embodiment, the enlarged mattress includes a rigid bottom member, integrally formed as part of the mattress, having a width of about 64 inches to about 68 inches and a length of about 77 inches to about 82 inches. The rigid bottom member is used to support the edge portions of the mattress that extend over the sides of a standard Queen sized foundation. The rigid bottom member may be hinged to accommodate folding for an adjustable bed. Because of this rigid bottom member, the enlarged mattress according to this aspect of the invention provides only one sleeping surface (i.e., it is a "one-sided" mattress). In other words, because of the rigid bottom member, this enlarged mattress cannot be flipped over to provide a second sleeping surface.

In another embodiment, a two-sided enlarged mattress is used with a standard Queen sized foundation, and a substantially flat, rigid support is provided between the mattress and the foundation. Advantageously, this substantially flat, rigid support will have an overall width of about 64 inches to about 68 inches and a length of about 77 to about 82 inches, to support the overhanging side edges of the enlarged mattress. If desired, the substantially flat rigid support may be constructed from two or more flat, rigid supports, and preferably the substantially flat, rigid support includes a first board having a width of about one half the width of the enlarged mattress and a length substantially the same as the length of the enlarged mattress, and a second board having a width of about one half the width of the enlarged mattress and a length substantially the same as the length of the enlarged mattress. These two boards are centered, side-by-side, such that a combined width of the first board and the second board substantially corresponds to the width of the enlarged mattress.

In another embodiment of the invention, a foundation is provided having a bottom surface that fits into a standard Queen sized bed frame and an enlarged upper surface that corresponds to the width of the enlarged mattresses according to the invention. This foundation comprises: a top support surface having a width of about 64 inches to about 68 inches and a length of about 77 inches to about 82 inches; a bottom support surface having a width of about 58 inches to about 61 inches and a length of about 77 inches to about 82 inches, wherein the top support surface extends outside of the width of the bottom support surface by about 2 inches to about 4 inches on each side of the bottom support surface.

In another embodiment of the invention, a two-sided enlarged mattress is used with a standard Queen sized foundation, and a rigid support is provided between the mattress and the foundation. This rigid support has an overall width of about 64 inches to about 68 inches and a length of about 77 inches to about 82 inches, to support the overhanging side edges of the enlarged mattress. The rigid support may be constructed of two parallel extending spaced apart members and at least two and preferably three transversely extending members attached thereto. This rigid support is positioned between the foundation and the two sided enlarged mattress and is centered such that the width of the rigid support corresponds to the width of the enlarged mattress.

The mattresses and foundations according to the invention can be used together to form a bed assembly. A base frame member of an appropriate size (depending on the size of the foundation bottom) can be used along with the mattress and foundation to hold the mattress and foundation above the floor.

Also, in all of the above embodiments of the invention, the enlarged surface of the mattress and/or foundation may be between about 65 inches to about 67 inches wide and about 78 inches to about 80 inches long.

BRIEF DESCRIPTION OF THE DRAWINGS

The invention will be better understood when considered in conjunction with the following detailed description and the appended drawings briefly described below.

DETAILED DESCRIPTION OF THE INVENTION

This invention will be described in more detail below, in conjunction with the attached figures that illustrate various embodiments of the invention. These embodiments are provided to illustrate the invention, not to limit it. In the figures and in this specification, the same reference number will be used consistently throughout to refer to the same part.

Figure 1:
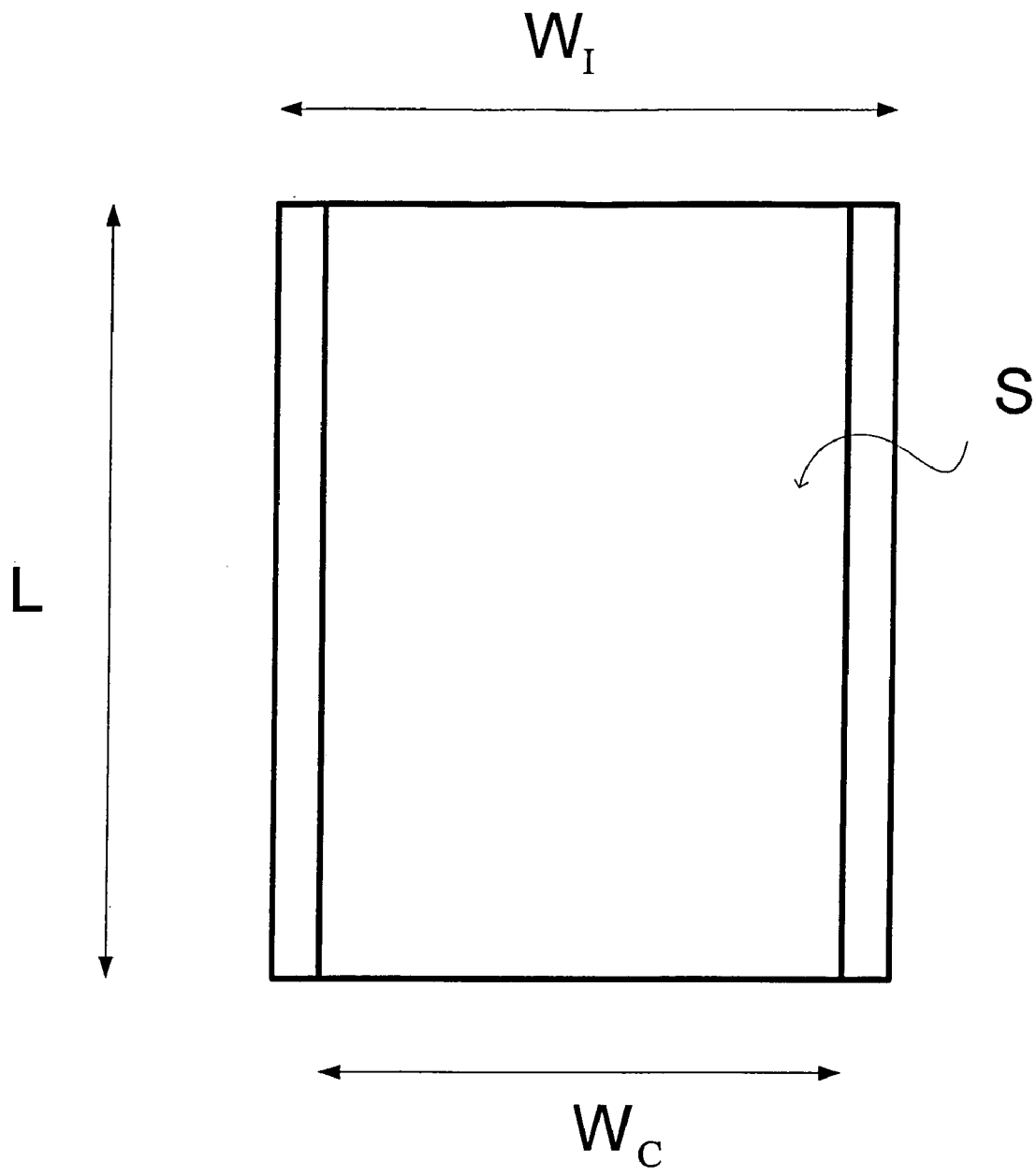
FIG. 1 is a schematic plan view which illustrates the differences between a mattress or foundation according to the invention and a standard Queen sized mattress or foundation.

Turning to FIG. 1, the top surface S of a mattress or foundation member according to the invention has a length L and a width $W_1$. In FIG. 1, the dimension $W_C$ illustrates the width of a conventional Queen sized mattress and foundation (about 59–60 inches wide), whereas the dimension $W_1$ illustrates the enlarged width of a mattress and/or foundation according to the invention. The mattress and/or foundation according to the invention has a width ($W_1$) of about 64 to about 68 inches, with about 65 inches to about 67 inches being preferred, and about 65.5 inches to about 66 inches being particularly preferred. The enlarged mattress and/or foundation according to the invention has a length (L in FIG. 1) of about 77 inches to about 82 inches, and advantageously between about 78 inches and about 80 inches. If desired, the mattress and/or foundation according to the invention can have a standard Queen sized length of about 79.5 to about 80 inches. Also, while the mattress according to the invention can have any suitable thickness, like a conventional mattress, the inner spring mattress according to the invention typically has a riser height or thickness of about 6 inches to about 9 inches.

Figure 2:
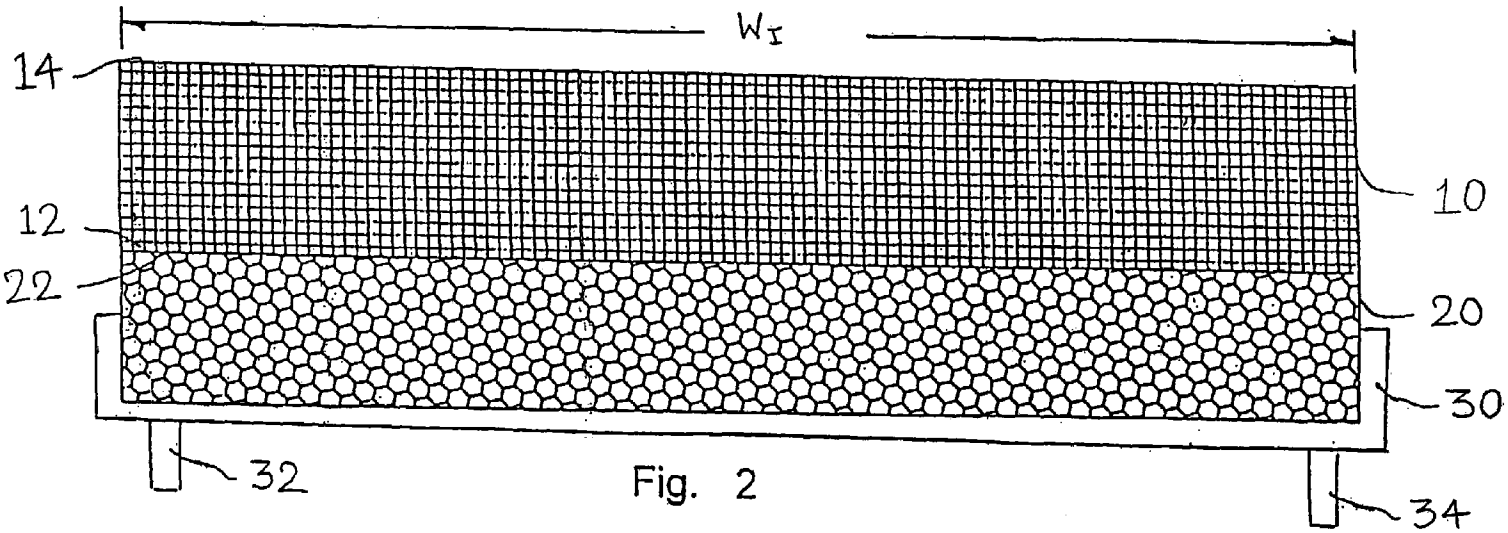
FIG. 2 is an end elevation view which illustrates a bed assembly according to the invention wherein both the mattress and foundation are of late last an "enlarged" size.

In a first embodiment of the invention, an end view of which is illustrated in FIG. 2, both the mattress 10 and the foundation 20 are constructed to have the enlarged width $W_1$ according to the invention. The top surface 22 of the foundation 20 supports the bottom surface 12 of the mattress 10 across the entire width $W_1$.

The mattress 10 may be of any conventional construction, provided the mattress 10 has the enlarged width $W_1$ described above to provide an enlarged sleeping surface S. For example, the mattress 10 may have a conventional inner spring mattress construction, comprising two identical sleep surfaces (the top surface 14 and the bottom surface 12), with an intermediate inner core assembly of wire springs covered with a padding at the top surface 14 and the bottom surface 12. This entire assembly may be encased within a ticking (optionally quilted) that is sewn together around its periphery to a border (boxing). Like a conventional inner spring mattress, the two-sided mattress 10, as illustrated in FIG. 2, may be periodically flipped over and/or rotated in order prevent, reduce, minimize, delay, and/or counteract sag, deflection, and/or compaction of the interior core support and padding materials. Left unchecked, the deflection and/or compaction of the padding material can become permanent and/or difficult to reverse.

The foundation 20 according to the invention also may be of a conventional construction, such as a conventional box spring construction. The foundation 20 of the present invention, however, has an enlarged surface area to support the enlarged mattress 10. Typically, foundations are composed of an assembly of wire springs or non-resilient structure attached to a rigid frame located at the bottom, and covered with a padded upper surface. The entire assembly may be encased within a ticking that is sewn (closed) together around its periphery to a border (boxing) and affixed to the underside of the rigid bottom frame. Often, a dust cover made of light plastic film or a like material is applied to the underside of the rigid bottom frame.

The foundation 20 and mattress 10 may be supported on a bed frame 30 having legs 32 and 34 to raise the foundation 20 to a desired level above the floor. The overall bed assembly also may include conventional slat supports (not shown) extending across the width of the bed frame 30 at one or more locations along the length to help support the foundation 20 on the frame 30, as well as a conventional headboard and/or footboard (also not shown). In the bed assembly illustrated in FIG. 2, all three main elements (i.e., the mattress 10, the foundation 20, and the bed frame 30) have an appropriate width to provide and/or accommodate the enlarged sleeping surface area and width $W_1$ of the bed assembly.

As other alternatives, the mattress 10 may have a variety of other conventional interior core constructions, including latex foam, polyurethane foam, or fiber pads, or the inner core may be composed of a bladder member that holds water, air, gels, or other gas, liquid, or semisolid support materials. The skilled artisan will be able to adapt these conventional mattress constructions to have an enlarged sleeping surface area S according to the invention through routine experimentation. Additionally, the skilled artisan will be able to produce and construct a suitable foundation and/or bed frame to support the specifically selected mattress construction through routine experimentation.

Figure 3:
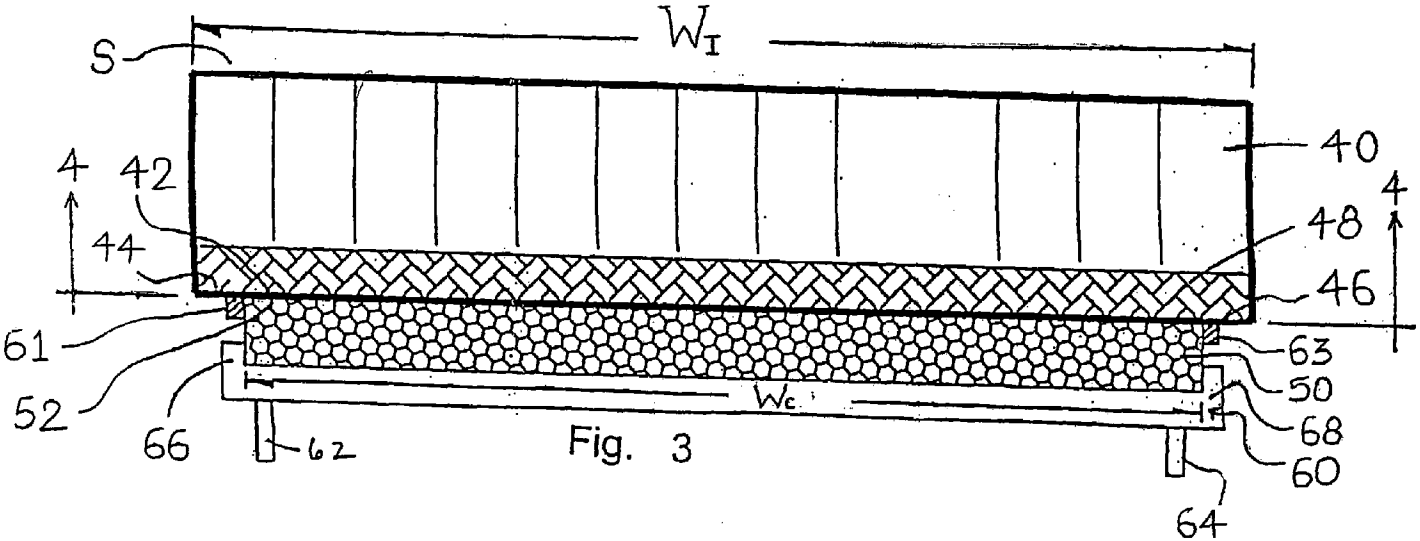
FIG. 3 is an end elevation view which illustrates a bed assembly according to the invention wherein the mattress is an "enlarged" size and the foundation is a conventional Queen size.

Another embodiment of the invention is illustrated in FIG. 3. In this embodiment, a mattress 40 having an enlarged size according to the invention (width $W_1$) is supported by a foundation 50 of conventional Queen size (outside width $W_C$). The bottom surface 42 of the mattress 40 is supported by the top surface 52 of the foundation 50. Again, the mattress 40 and foundation 50 can be supported above the floor level using a bed frame 60 having legs 62 and 64. In this instance, the bed frame 60 is of conventional size and construction for holding and supporting a foundation 50 of conventional Queen size (inside width $W_C$).

In this version of the bed assembly according to the invention, as shown in FIG. 3, the two side edges 44 and 46 of the mattress 40 extend over the two side edges of the foundation 50 (i.e., the mattress 40 is wider than the foundation 50). Typically, this overhanging width is from about 2 to about 4 inches on each side, and preferably about 3 inches on each side. In order to support the overhanging mattress edges 44 and 46, the mattress 40 includes a rigid, preferably flat, bottom member 48 integrally positioned within the mattress 40. Although some variance may be possible, preferably this rigid bottom member 48 has a width corresponding to the width ($W_1$) of the mattress 40 (about 64 inches to about 68 inches) and a length corresponding to the length (L) of the mattress (typically about 77 inches to about 82 inches). The rigid bottom member 48 may be made from wood, particle board, or any other suitable rigid support material, and it may be made from any suitable number of independent pieces, provided the overall rigid bottom member provides adequate strength to support the overhanging edges 44 and 46 of the mattress 40 and its users. The rigid bottom member 48 also need not be a continuous solid sheet of material (i.e., open spaces may be provided in the interior of member 48).

Figure 4:
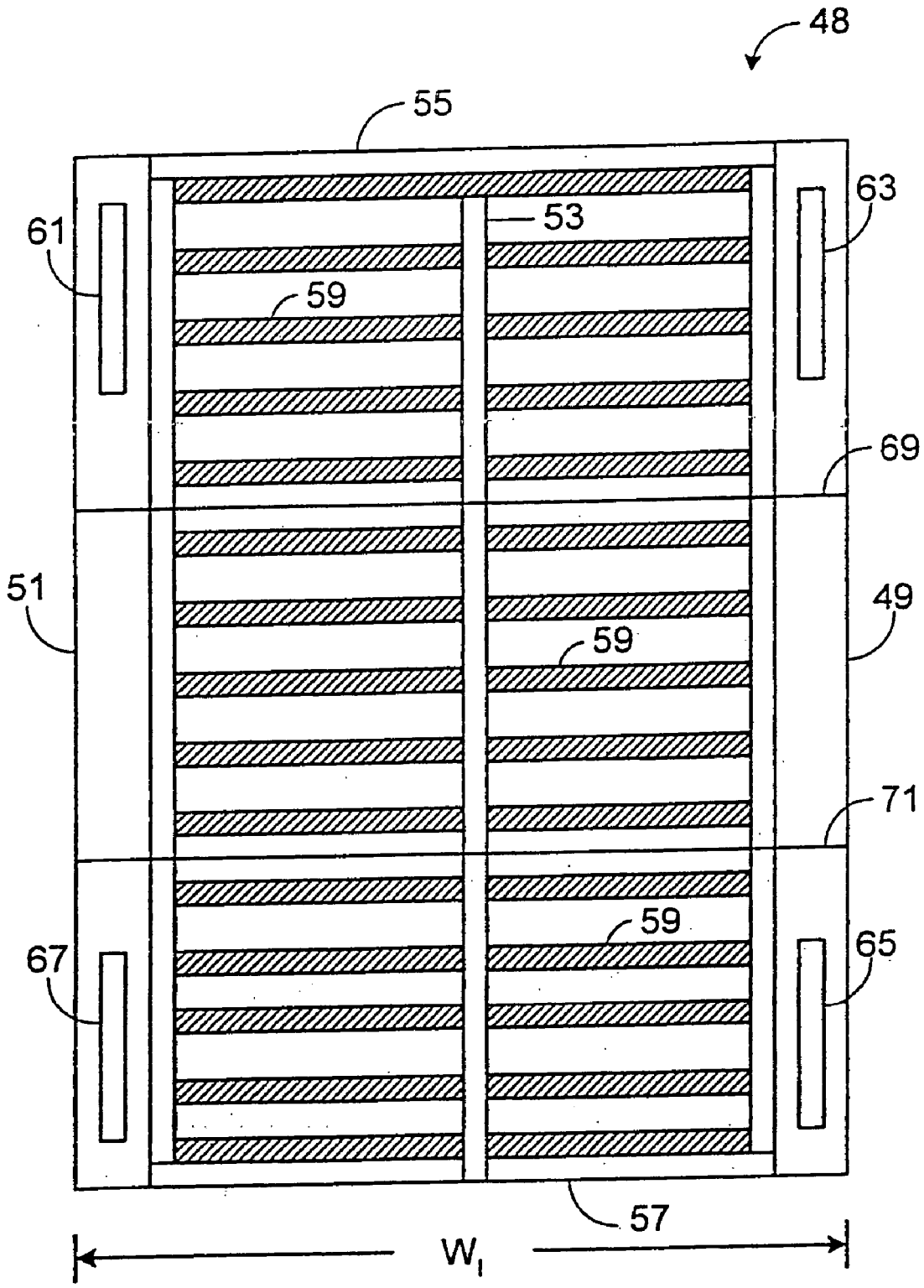
FIG. 4 is a bottom plan view of the mattress shown in FIG. 3 as seen along line 4—4 of FIG. 3.

Turning to FIG. 4, one embodiment of the rigid member 48 is shown. The rigid member comprises side rails 49 and 51 and center support 53. The side rails 49 and 51 and center support 53 extend along the length of the rigid member 48. The side rails 49 and 51 and center support 53 are connected together by means of end rails 55 and 57 and a plurality of cross slats 59. The side rails 49 and 51, the center support 53, the end rails 55 and 57, and the cross slats 59, may all be constructed of wood. Other materials, such as plastic, metal, or other suitable rigid material could be used in place of wood.

The rigid member 48 also includes side stabilizers 61, 63, 65, and 67. The side stabilizers 61, 63, 65, and 67 extend a few inches below the bottom surface of the rigid member 48 (and therefore the mattress 40) and engage the edges of the supporting foundation 50 (FIG. 3). By engaging the edges of the foundation 50, the mattress 40 is centered on the foundation 50 and is retained in that position by the side stabilizers 61, 63, 65, and 67. In that fashion, the mattress 40 cannot slide from one side to the other of the smaller foundation 50.

The rigid member 48 may also be divided into three sections along its length as illustrated by dividing lines 69 and 71. The side rails 49 and 51 and center support 53 may be hinged at the dividing lines 69 and 71 so that the mattress 40 can be folded and thereby adapted for use with an adjustable bed.

The inner core of the mattress 40, above the rigid bottom member 48, may be of conventional mattress construction, including springs, padding, foams, bladders, etc., as described above. Also, the side members 66 and 68 of the bed frame 60 may be constructed to help support the overhanging edges 44 and 46 of the mattress 40, although this is not a requirement (i.e., the foundation 50 and mattress 40 can be held by a conventional Queen sized bed frame that would not directly support the side edges 44 and 46 of the mattress 40, as illustrated in FIG. 3).

The mattress 40 of the invention as illustrated in FIG. 3, provides only a single sleeping surface (top surface S). In other words, this mattress 40 cannot be flipped over so that the user could alternately sleep on the bottom surface 42 because the rigid bottom member 48 with its protruding side stabilizers makes the bottom surface 42 unsuitable for sleeping. This fact, however, provides some significant advantages to the structure shown in FIG. 3. For example, because the mattress 40 has only one sleeping surface and the bottom surface 42 is rigid for supporting purposes, about 50% less padding material is used for the one-sided mattress 40 of FIG. 3 as compared to a conventional two-sided mattress construction. Because less padding is used, there is less compaction of the padding, and consequently, less sag and deflection in the mattress 40 of FIG. 3 (sag and deflection can interfere with a mattress intended function of providing a supportive and resilient sleep surface). The user also is not exposed to the inconvenience of having to periodically flip over the mattress 40 (although occasional 180 degree rotations of the mattress 40 may still be beneficial for reducing some sagging, deflection, and compaction).

The bed assembly according to the embodiment illustrated in FIG. 3 also is advantageous because the enlarged mattress 40 can be used with a conventional Queen sized foundation 50 and bed frame 60. This would enable one to obtain the advantages of the enlarged mattress 40 without the need to also spend money obtaining an enlarged foundation and/or bed frame like those shown in FIG. 2.

Figure 5:
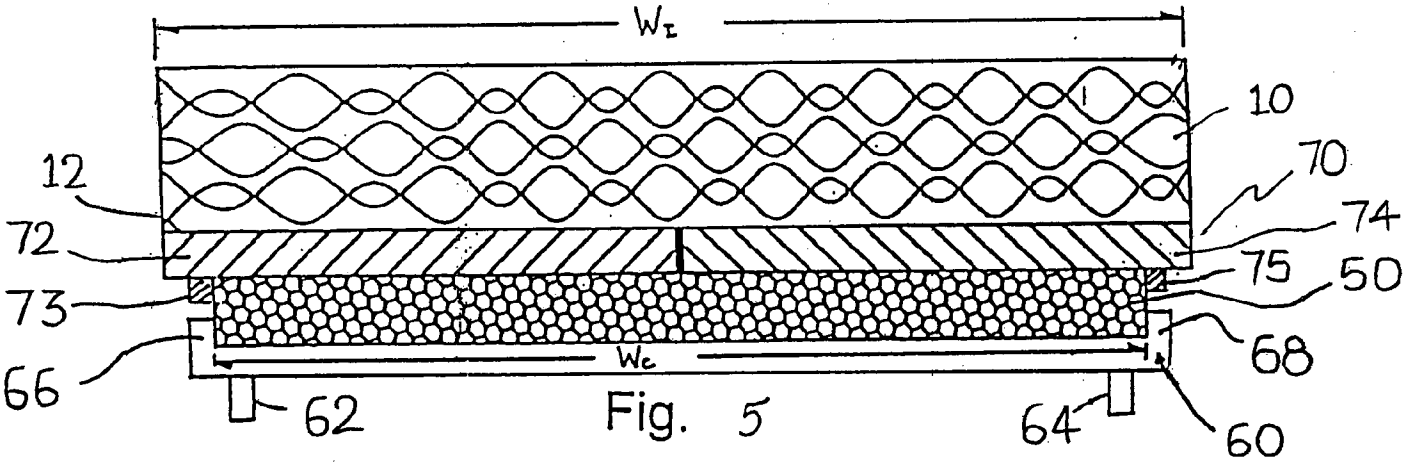
FIG. 5 is an end elevation view which illustrates another bed assembly according to the invention wherein the mattress is an "enlarged" size, the foundation is a conventional Queen size, and a rigid support is provided between the mattress and foundation.

FIG. 5 illustrates another embodiment of the invention wherein an enlarged two-sided mattress 10 of width $W_1$ according to the invention is supported by a conventional Queen sized foundation 50 (width $W_C$) and a conventional Queen sized bed frame 60. In this embodiment of the invention, a substantially flat, rigid support member 70 is provided between the lower surface 12 of the two-sided enlarged mattress 10 and the top surface 52 of the conventional Queen sized foundation 50. In the illustrated embodiment, the substantially flat, rigid support member 70 has an overall width ($W_1$) of about 64 to about 68 inches (which corresponds to the overall width of the mattress 10), and an overall length (L) of about 77 inches to about 82 inches (which corresponds to the overall length of the mattress 10 and the foundation 50). The substantially flat, rigid support member 70 (also called a "bunkie board") may be composed of two support boards 72 and 74. The bunkie board 70 is divided into the two support boards 72 and 74 to make handling easier where the bunkie board 70 has to be maneuvered through small doorways and/or staircases.

When the bunkie board 70 is in place under the mattress 10, the two support boards 72 and 74 are oriented side by side such that the first board 72 has a width of about one half the overall width of the mattress 10 and a length substantially the same as the length of the mattress 10, and the second board 74 has a width of about one half the overall width of the mattress 10 and a length substantially the same as the length of the mattress 10. When located side by side, the first board 72 and the second board 74 have a combined width substantially corresponding to the overall width of the mattress 10 and overhang the edges of he foundation 50. The support boards 72 and 74 may be made of plywood, particle board, plastic, metal, or any other suitable rigid support material. Typically, the bunkie board 70 is upholstered for aesthetic purposes. The rigid support member 70 may also have side stabilizers 73 and 75 which center the rigid support member 70 on the narrower foundation 50.

The use of the separate bunkie board 70 in conjunction with the enlarged mattress 10 provides an accessible space between the top of the bunkie board 70 and the bottom of the mattress 10 into which the top sheet of the bed clothing may be tucked. The upholstering on the bunkie board 70 and on the mattress 10 assure that the space between the mattress 10 and the bunkie board 70 is smooth so that the top sheet can be easily tucked into that space.

The embodiment of the invention illustrated in FIG. 5 differs from the embodiment illustrated in FIG. 3 in that the substantially flat rigid member 70 is independent from and external to the mattress 10 (in the embodiment of FIG. 3, the rigid member 48 was integrally formed as part of the mattress 40). While the embodiment of FIG. 5 may include two boards 72 and 74 arranged side by side, other arrangements are possible without departing from the invention provided that the boards can be adequately held in place (e.g., four boards arranged in a 2×2 array). Also, if desired, the edges 66 and 68 of the bed frame 60 can be extended and thereby help support the overhanging edges of the boards 72 and 74.

Figure 6:
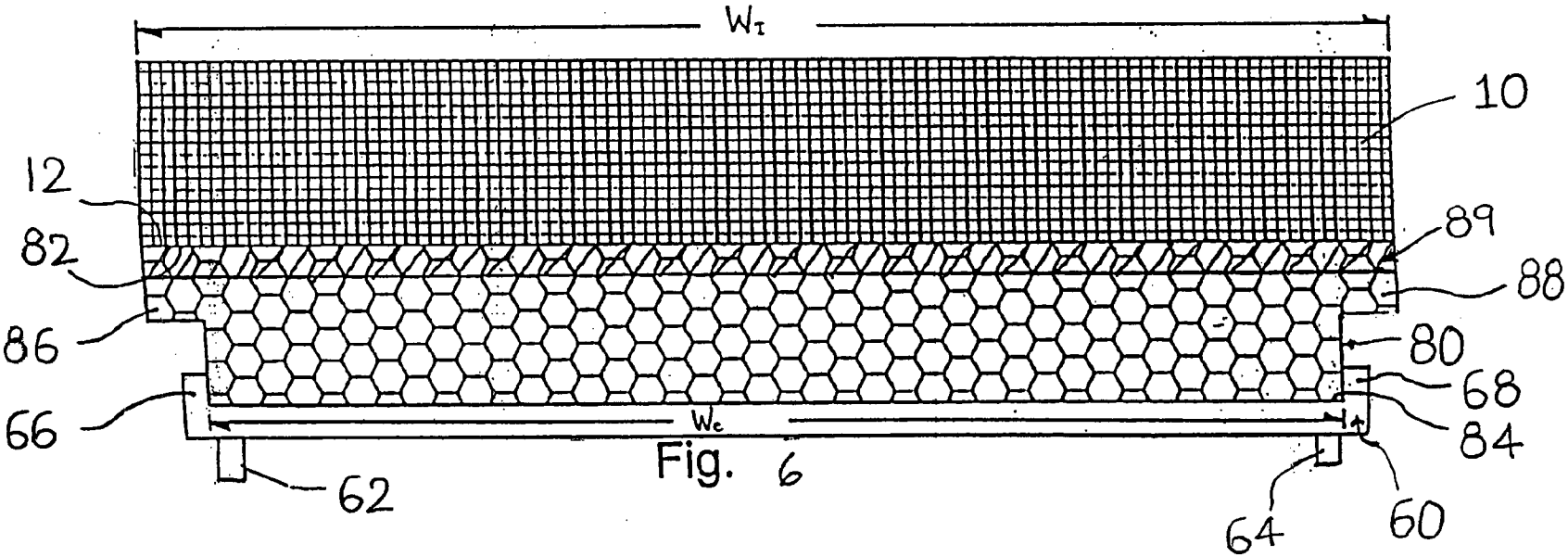
FIG. 6 is an end elevation view which illustrates another bed assembly according to the invention wherein the foundation has one "enlarged" surface and one conventional Queen sized surface.

FIG. 6 illustrates another embodiment of the invention wherein an enlarged two-sided mattress 10 having a width of $W_1$ is used with a bed frame 60 of conventional Queen size (width $W_C$). In this embodiment of the invention, the foundation member 80 has an enlarged upper surface 82 (width $W_1$) which supports the lower surface 12 of the mattress 10. However, the lower surface 84 of the foundation 80 has a conventional Queen size (width $W_C$) so that the foundation 80 fits into the conventional Queen sized bed frame 60. Again, if desired, the edges 66 and 68 of the bed frame 60 can be extended and used to support the overhanging edges 86 and 88 of the foundation 80.

The foundation 80 can be constructed of conventional materials used for making box springs or other bed foundations, provided the top surface 82 in some manner "mushrooms" outward to support the full width $W_1$ of the enlarged mattress 10. Those of ordinary skill in the art will be capable of making a suitable foundation 80 with this "mushroom" configuration through routine experimentation. The foundation 80 includes a rigid, preferably flat, top member 89 integrally provided within the foundation 80. Although some variance may be possible, preferably this rigid top member 89 has a width corresponding to the width of the mattress 10 (about 64 inches to about 68 inches) and a length corresponding to the length of the mattress (typically about 77 inches to about 82 inches). The rigid top member 90 may be made from wood, particle board, plastic, metal, or any other suitable rigid support material, and it may be made from any suitable number of independent pieces, provided the overall rigid top member provides adequate strength to support the mattress and users. The rigid top member 89 also need not be a continuous solid sheet of material (i.e., open spaces may be provided in the interior of member 89). The member 89 may also be constructed in the same fashion as the rigid member 48 (without the side stabilizers 61, 63, 65, and 67) as shown in FIG. 4.

In the embodiments of the invention illustrated in FIGS. 5 and 6, the one-sided mattress 40 (without the side stabilizers 61, 63, 65, and 67) illustrated in FIGS. 3 and 4 also can be used without departing from the invention. As described above, because of the reduced amount of padding, use of the one-sided mattress 40 (without the side stabilizers 61, 63, 65, and 67) shown in FIGS. 3 and 4 has an advantage of reduced sag, deflection, and compaction as compared to use of a conventional two-sided mattress construction that has a larger amount of padding.

Figure 7:
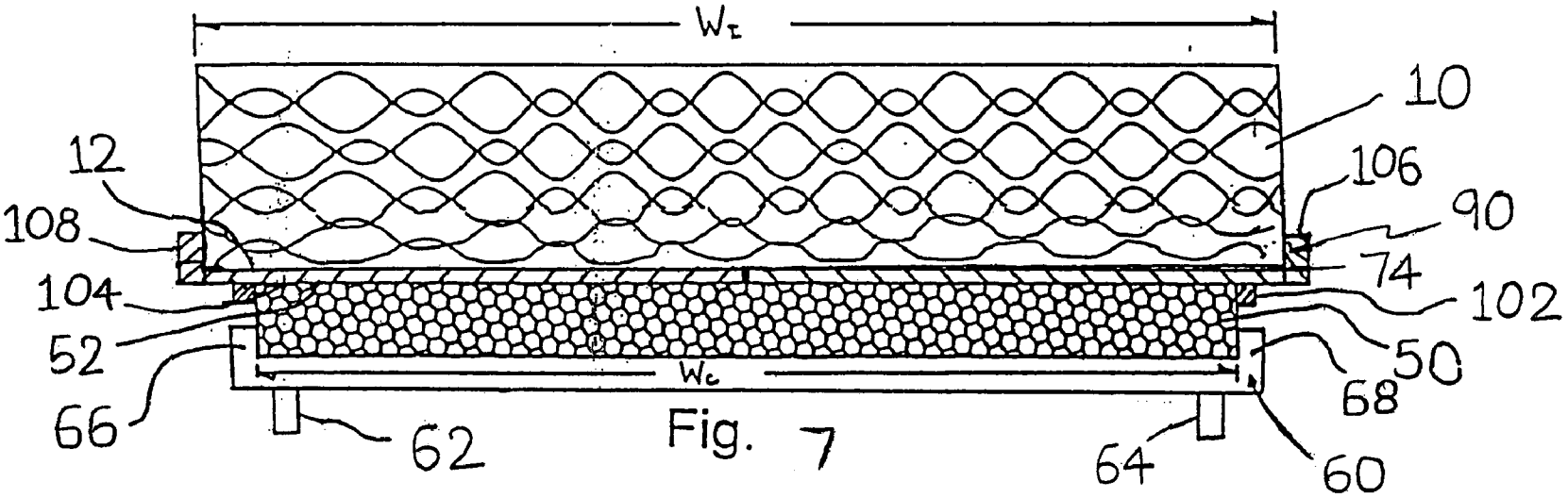
FIG. 7 is an end elevation view which illustrates another bed assembly according to the invention wherein the mattress is an "enlarged" size, the foundation is a conventional Queen size, and a rigid support is provided between the mattress and foundation.
Figure 8:
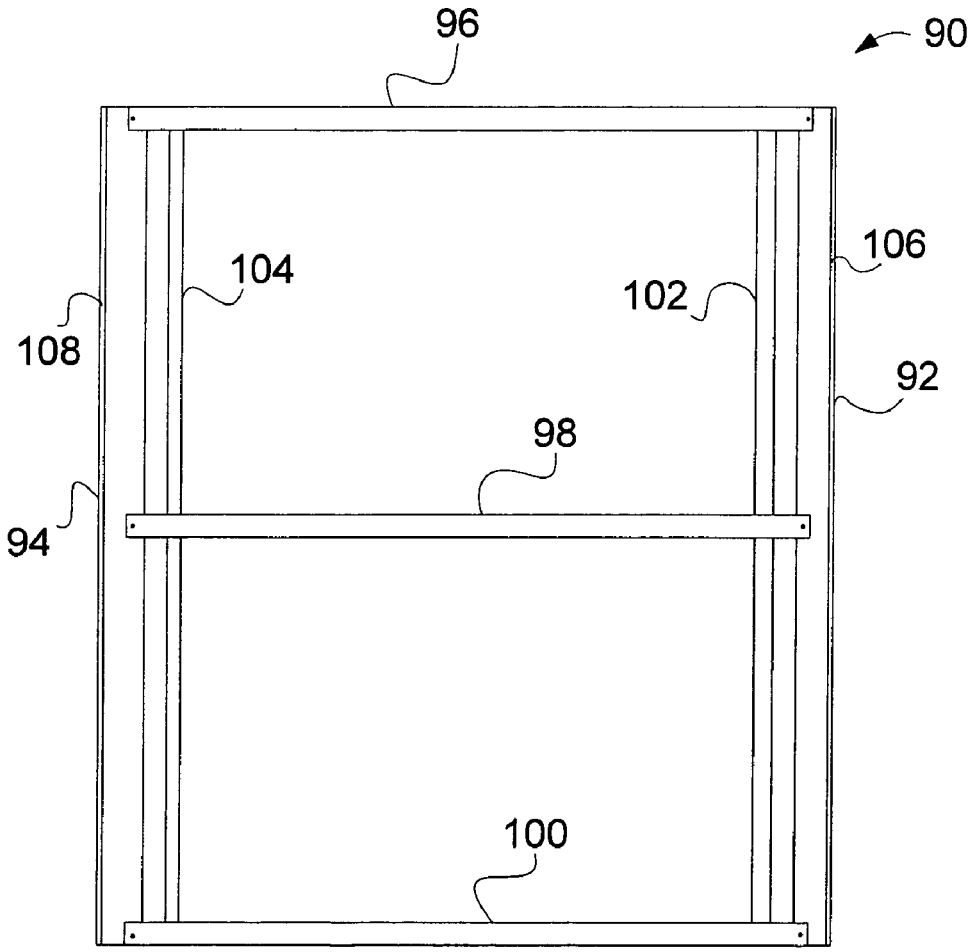
FIG. 8 is a plan view which illustrates the rigid support used in the bed assembly illustrated in FIG. 7.

FIG. 7 illustrates another embodiment of the invention wherein an enlarged two-sided mattress 10 of width $W_1$ according to the invention can be coupled with a conventional Queen sized foundation 50 and a conventional Queen sized bed frame 60. In this embodiment of the invention, a rigid support member 90 is provided between the lower surface 12 of the two-sided enlarged mattress 10 and the top surface 52 of the conventional Queen sized foundation 50. In the illustrated embodiment, the rigid support member 90 has an overall width of about 64 to about 68 inches (which corresponds to the overall width ($W_1$) of the mattress 10), and an overall length of about 77 inches to about 82 inches (which corresponds to the overall length (L) of the mattress 10 and the foundation 50). The rigid support member is composed of two parallel extending spaced apart members and at least two transversely extending members attached thereto, as shown in FIG. 8. The rigid support member 90 may be made of metal, wood, plastic, or any other suitable rigid support material.

Figure 9:
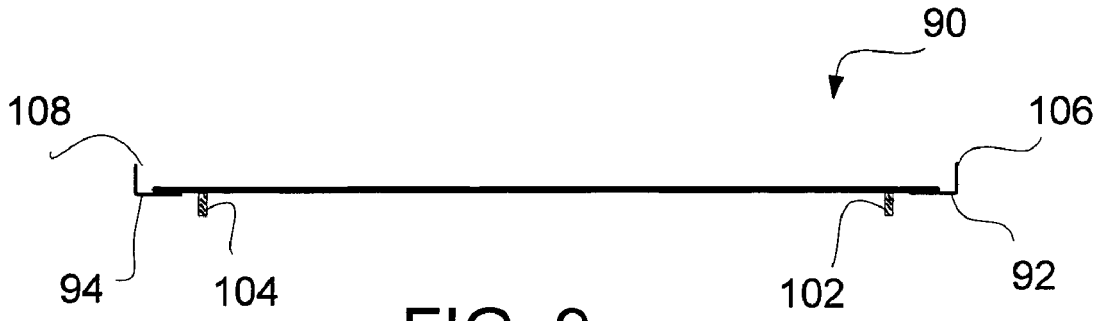
FIG. 9 is an end elevation view which illustrates the rigid support used in the bed assembly illustrated in FIG. 7.

The rigid support member 90, as illustrated in FIGS. 7 and 8, has two parallel side members 92 and 94 and three parallel cross members 96, 98, and 100. The embodiment of the invention illustrated in FIG. 7 differs from the embodiment illustrated in FIG. 5 in that the rigid support member 90 illustrated in FIGS. 7 and 8 does not add as much height to the bed as the rigid support member 70 illustrated in FIG. 5. While the rigid support member 90 shown in FIGS. 8 and 9 includes three transversely extending members 96, 98, and 100, other arrangements are possible without departing from the invention. Also, the support member 90 has downwardly extending side stabilizers 102 and 104 and upwardly extending side stabilizers 106 and 108. The downwardly extending side stabilizers 102 and 104 engage the sides of the conventional Queen sized foundation 50 to center the rigid support member 90 on the foundation 50 and keep the rigid support member 90 from moving from side to side. The upwardly extending side stabilizers 106 and 108 retain the enlarged mattress 10 from moving from side to side.

The enlarged mattresses and bed assemblies according to this invention have been found to significantly reduce motion transferred from movement of one person on the mattress to another. For testing purposes, the motion transfer is quantified by measuring the motion transferred from a standardized energy source to a mannequin that represents a human of average body size and weight resting on the mattress surface. In one test procedure, the standardized energy source is a standard rollator (ASTM F1566) that acts on one lateral side of the mattress, and the horizontal and vertical movement induced on a mannequin positioned on the other lateral side of the mattress is measured. Several tests are run over time and the data is averaged to produce the transferred motion values.

The amplitude of movement created and transferred to the mannequin will vary, depending on the type of mattress and box spring foundation used. A woven wire inner spring mattress will transfer motion differently than a marshal coil-type mattress, although both types of mattress constructions can be used according to the invention. The types of box springs used (e.g., continuous wire or module) also will affect the motion transferred, but again, both types can be used in foundations according to the invention. Those of ordinary skill in the art can select appropriate mattress and foundation constructions to provide the desired and acceptable degree of motion transfer without departing from the invention. The one-sided mattress construction according to the invention has been found to be particularly effective in reducing horizontal and vertical motion in rollator transfer of motion tests.

The standard rollator also can be used to induce and test the amount of compaction (depression and sag) produced in a given mattress construction. The one-sided mattress construction according to the invention has been found to be particularly effective in reducing compaction.

To illustrate the advantages of the present invention over various mattresses in the prior art, the following table contains test data obtained by Simmons Company, the assignee of the present invention. The table documents the results of a transfer of motion evaluation test, developed by Simmons Company. The motion evaluation was performed on both a standard Queen sized mattress and on an enlarged mattress of the present invention. The transferred motion value was measured for each mattress.

TABLE I

| MATTRESS TYPE | DIMENSIONS | TRANSFERRED MOTION VALUE |
|---|---|---|
| Queen Mattress | 60 inches by 80 inches | 0.295 inches |
| Enlarged Mattress | 66 inches by 80 inches | 0.196 inches |

As shown in the above table, the transferred motion value of the enlarged mattress is 33.6% less than the transferred motion value of the standard Queen sized mattress. As the test results indicate, the enlarged mattress is successful at transferring less motion to a sleeping partner.

As is readily evident from the above discussion, the mattresses and bed assemblies according to the invention are advantageous because they provide an enlarged sleeping surface area while providing an overall size more suitable to the user's space requirements. In many embodiments of the invention, the enlarged mattress size can be adapted for use with standard Queen sized foundations and bed frames, which saves consumers costs in switching to larger sized beds. The mattresses and foundations according to the invention also are advantageous in that they are less costly to manufacture than standard King sized beds (due to material savings), require less maintenance (turning and rotating), produce less transfer of motion (for a more restful sleep), and provide a more aesthetic appearance when placed on a conventional Queen sized foundation (due to minimal visibility of a gap between the foundation and frame).

Those of ordinary skill in the art will appreciate that this specification describes various preferred embodiments of the invention, for purposes of illustration, and that various changes and modifications can be made to the specifically disclosed embodiments without departing from the spirit and scope of the invention as defined in the claims that follow.

We claim:

1. A bed assembly, comprising:

a mattress having a top surface, a bottom surface, and an inner core between the top surface and the bottom surface, wherein the mattress has a width and a length; and a foundation for supporting the bottom surface of the mattress, wherein the foundation has a width that is less than the width of the mattress and a length that is substantially identical to the length of the mattress;

a rigid support member located between the mattress and the foundation wherein the rigid support member includes spaced-apart first members extending lengthwise along edge portions of the mattress and having first side stabilizers for engaging the edge portions of the mattress therebetween, at least two transversely extending members connecting the spaced-apart first members, and second side stabilizers extending lengthwise along edge portions of the foundation and depending downward from the first members or the transversely extending members for engaging the edge portions of the foundation therebetween.

2. The bed assembly according to claim 1, wherein the rigid support member is hinged for folding.

3. The bed assembly according to claim 1, wherein the rigid support member is formed of at least two support boards.

4. The bed assembly according to claim 3, comprising a first board having a width of about one half the width of the mattress and a length substantially the same as the length of the mattress, and a second board having a width of about one half the width of the mattress and a length substantially the same as the length of the mattress.

5. The bed assembly of claim 1, wherein the spaced-apart first members are L-shaped.

6. The bed assembly of claim 1, wherein the transversely extending members are connected to the spaced-apart first members using one of a fastener and an adhesive.

7. The bed assembly of claim 1, wherein the rigid support member is formed of at least one of wood, particle board, plastic, or metal.

8. The bed assembly of claim 1, wherein the inner core of the mattress includes a bladder.

9. The bed assembly of claim 8, wherein the bladder contains a gel.

10. The bed assembly of claim 8, wherein the bladder holds air.

11. The bed assembly of claim 8, wherein the bladder holds water.

* * * * *